US006126094A

United States Patent [19]

Ricco

[11] Patent Number: 6,126,094

[45] **Date of Patent: *Oct. 3, 2000**

[54] INTERNAL COMBUSTION ENGINE FUEL INJECTOR

[75] Inventor: Mario Ricco, Bari, Italy

[73] Assignee: Elasis Sistema Riocerca Fiat Nel Mezzogiorno Societa Consortille per Azioni, Pomigliano d'Arco, Italy

[ * ] Notice: This patent is subject to a terminal disclaimer.

[21] Appl. No.: 09/112,909

[22] Filed: Jul. 9, 1998

[30] Foreign Application Priority Data

Jul. 11, 1997 [IT] Italy ..... T097A0617

[51] Int. Cl.[7] ..... B05B 1/30

[52] U.S. Cl. ..... 239/585.1; 239/585.4; 251/129.16; 251/129.18; 251/129.21

[58] Field of Search ..... 239/585.1, 585.2, 239/585.3, 585.4, 585.5, 533.1, 533.2, 533.3, 533.6, 533.8, 533.9, 533.15; 251/129.18, 129.16, 129.21; 123/470, 472; 335/273

[56] References Cited

U.S. PATENT DOCUMENTS 3,464,627 9/1969 Huber ..... 239/96
5,395,048 3/1995 Ricco et al. ..... 239/533.8
5,560,549 10/1996 Ricco et al. ..... 239/533.8
5,901,941 5/1999 Ricco ..... 251/129.16

FOREIGN PATENT DOCUMENTS 0318743 6/1989 European Pat. Off. .
0604915 7/1994 European Pat. Off. .
0753658 1/1997 European Pat. Off. .

*Primary Examiner*—Andres Kashnikow
*Assistant Examiner*—Lisa Ann Douglas
*Attorney, Agent, or Firm*—Ladas & Parry

[57] ABSTRACT

The injector has a hollow body carrying a nozzle; a metering valve; and an electromagnet for activating an armature controlling the valve. The electromagnet is housed inside a jacket integral with an end wall fitted with a discharge fitting of the valve. The armature is guided by a guide member having a thread engaging a corresponding thread of the hollow body, independently of fitment of the body of the valve. A spacer of modular size is provided between the electromagnet and the guide member to adjust the gap between the armature and the electromagnet. The jacket is fitted to the hollow body by screwing a cover onto the hollow body.

15 Claims, 2 Drawing Sheets

INTERNAL COMBUSTION ENGINE FUEL INJECTOR

BACKGROUND OF THE INVENTION

The present invention relates to an internal combustion engine fuel injector. In particular, the invention relates to an injector comprising a metering valve controlled by an electromagnet.

In known injectors of the above type, the armature of the electromagnet is normally connected to a stem guided by a sleeve fitted inside a cavity of the injector body together with the metering valve body. The core of the electromagnet, on the other hand, is fitted between a shoulder of a jacket and a disk supporting the discharge fitting of the metering valve, by deforming an edge of the jacket on the disk; and the jacket has an internal thread by which it is screwed to an external thread on the injector body.

Injectors of this type have several drawbacks. In particular, as the core of the electromagnet is made of sintered metal material and therefore relatively fragile, deforming the edge of the jacket on the core may result in damage to the core both at the edge and at the shoulder of the jacket.

Moreover, the deformed edge of the jacket fails to provide for fuel sealing, so that a seal is required between the core and the jacket; and, to complete the connection between the deformed edge and the disk, a cap of plastic material is required, which also incorporates the electric pin of the electromagnet coil.

SUMMARY OF THE INVENTION

It is an object of the present invention to provide an injector of the above type, which is easy to assemble, highly reliable, and provides for overcoming the aforementioned drawbacks typically associated with known injectors.

According to the present invention, there is provided an injector comprising a hollow body fitted with a nozzle; a metering valve for opening said nozzle; and an electromagnet for activating an armature controlling said metering valve; said armature being guided by a guide member; said metering valve and said guide member being fitted inside a cavity of said hollow body; and said electromagnet being housed inside a jacket fitted to said hollow body; characterized in that said jacket is made in one piece with an end wall against which said electromagnet rests.

According to a further aspect of the invention, the inner surface of said jacket is cylindrical with no shoulders; a spacer being provided between said guide member and said electromagnet.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
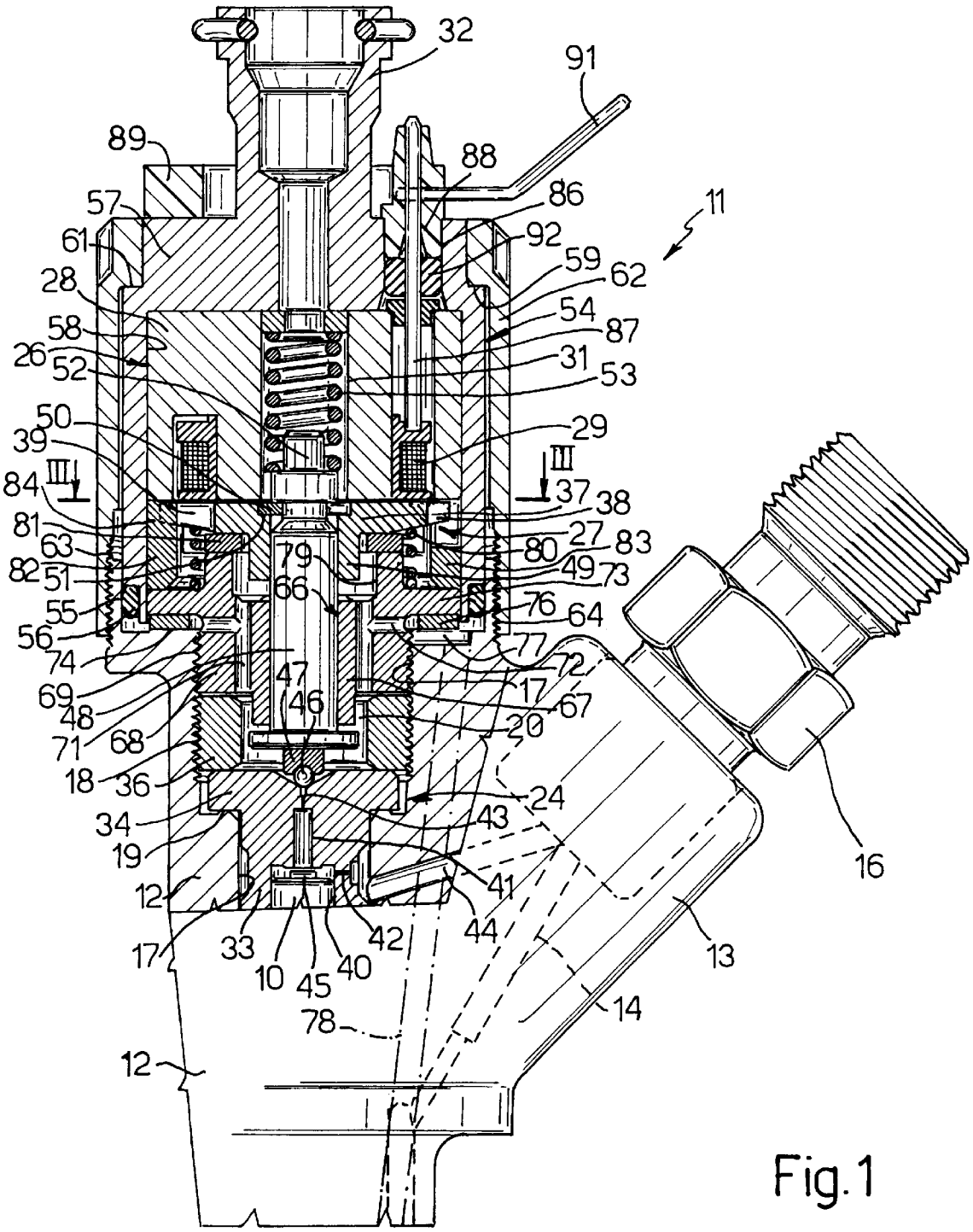
FIG. 1 shows a partial section of a fuel injector in accordance with the invention.

Number 11 in FIG. 1 indicates as a whole a fuel injector, e.g. for a diesel internal combustion engine. Injector 11 comprises a hollow body 12 fitted with an injector (not shown) terminating at the bottom with one or more injection orifices. A control rod 10 slides inside body 12, and is connected to a pin for closing the injection orifice. And body 12 comprises an appendix 13 in which is inserted an inlet fitting 16 connected to a normal fuel supply pump; a conduit 14 for connecting fitting 16 to an injection chamber of the nozzle; and a substantially cylindrical cavity 17 having a thread 18 and a shoulder 19.

Injector 11 also comprises a metering valve indicated as a whole by 24, and which is housed inside cavity 17 and controlled by an electromagnet 26 controlling an armature 27. The maximum-diameter portion of cavity 17 defines the discharge chamber 20 of valve 24; electromagnet 26 has an annular magnetic core 28 housing a normal electric coil 29; and core 28 has a central hole 31 coaxial with a discharge fitting 32 connected to the fuel tank.

Figure 3:
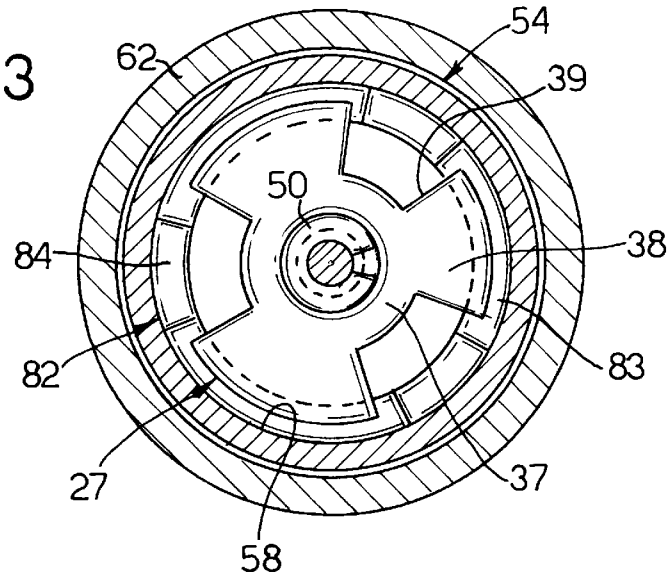
FIG. 3 shows a section along line III—III in FIG. 1.

Metering valve 24 comprises a cylindrical valve body 33 having a flange 34, which is normally held resting against shoulder 19 of cavity 17 by a ring nut 36 threaded externally and screwed to thread 18 of cavity 17. Armature 27 substantially comprises a disk 37, which cooperates magnetically with core 28, and in turn comprises a number of sectors 38, e.g. three (FIG. 3), separated by openings 39 through which discharge chamber 20 communicates with central hole 31 of core 28.

Body 33 of valve 24 comprises an axial control chamber 41, in turn comprising a discharge conduit 43 communicating with cavity 17; hollow body 12 comprises an axial hole 40 adjacent to chamber 41 and in which rod 10 slides; and body 33 comprises an inlet conduit 42, which terminates in the end portion of hole 40 and communicates with fitting 16 via a further conduit 44 of hollow body 12.

The top end of rod 10 has an appendix 45 for cutting off communication between hole 40 and chamber 41 without closing inlet conduit 42; the fuel pressure keeps rod 10 normally in the lowered position closing the orifice of the nozzle of injector 11; discharge conduit 43 of control chamber 41 is normally closed by a shutter in the form of a ball 46, which rests on a conical seat defined by the contact surface with conduit 43; and ball 46 is guided by a guide plate 47 on which acts a cylindrical stem 48 of armature 27.

More specifically, disk 37 of armature 27 is integral with a sleeve 49 sliding axially on stem 48; stem 48 has a groove in which is inserted a C-shaped ring 50 cooperating with a shoulder 51 of armature 27, so that armature 27 is disconnected from stem 48; and stem 48 extends a given length inside hole 31, and terminates with a small-diameter portion 52 for supporting and securing a first compression spring 53 housed inside hole 31.

According to the invention, core 28 of electromagnet 26 is housed inside a jacket indicated as a whole by 54, and which is made of nonmagnetic material and connected to a portion 55 of hollow body 12 by a seal 56. Jacket 54 is made in one piece with an end wall 57 supporting fitting 32, has a perfectly cylindrical inner surface 58 with no shoulders whatsoever, and has an outer shoulder 59 engaged by an inner shoulder 61 of a cylindrical cover 62 made of steel and having an inner thread 63 which screws onto an outer thread 64 of portion 55 of body 12.

Figure 2:
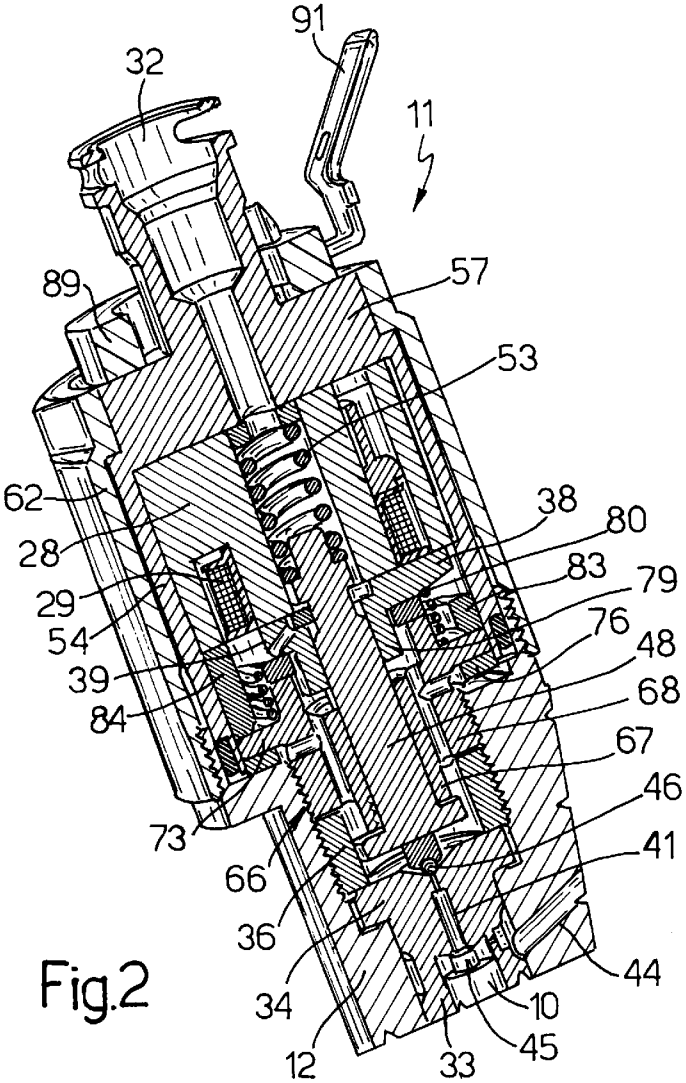
FIG. 2 shows a partial section of the FIG. 1 injector.

Metering valve 24 comprises a guide member indicated as a whole by 66 (see also FIG. 2) and comprising a sleeve 67 in which slides stem 48 of armature 27. Sleeve 67 comprises a portion 68 having a larger outside diameter and an external thread 69 which screws onto thread 18 of cavity 17; and portion 68 has a number of axial conduits 71 and radial conduits 72 connecting conduit 43 to discharge chamber 20.

Guide member 66 also has a flange 73, which rests on a further shoulder 74 of hollow body 12 via a spacer 76; shoulder 74 has a radial groove 77 communicating with the usual discharge conduit 78—indicated by the dot-and-dash line in FIG. 1—for the seat of rod 10 in body 12; guide member 66 has a prismatic seat 79 for an Allen wrench; a compression spring 80, over which prevails spring 53, is fitted between flange 73 and disk 37 of armature 27; and a bush 81 is fitted between the top end of guide member 66 and disk 37 to enable rapid return to the rest position and damp rebound of armature 27.

Figure 4:
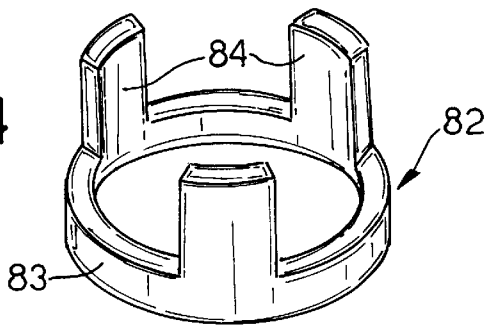
FIG. 4 shows a view in perspective of a detail of the injector.

A spacer or intermediate member 82 is provided between core 28 of electromagnet 26 and flange 73, and comprises an annular portion 83 (see also FIG. 4) which rests against flange 73, and a number of feet 84 integral with annular portion 83 and which fit through the openings 39 in disk 37 of armature 27 to engage core 28 of electromagnet 26. In the example shown, in which the armature comprises three sectors, spacer 82 has three feet; for an armature with four sectors, the spacer has four feet, and so on.

Spacers 82 with feet 84 of modular lengths differing by very small amounts are provided to adjust the gap between disk 37 of armature 27 and core 28 by selecting the appropriate spacer 82; and annular spacers 76 of modular thickness may also be provided to adjust the travel of armature 27 towards core 28 of electromagnet 26.

End wall 57 of jacket 54 has a hole 86 through which extends an electric cable 87 connected to coil 29; cable 87 is embedded in an appendix 88 of a ring 89 of insulating plastic material, and is connected to a pin 91 for electrically connecting coil 29 to the usual electric circuit of the engine; and ring 89 is inserted inside hole 86 via the interposition of a seal 92.

Metering valve 24 of injector 11 is assembled as follows.

Body 33 of valve 24 is inserted inside cavity 17 of hollow body 12, and ring nut 36 is screwed to thread 18 until flange 34 contacts shoulder 19. Stem 48 of armature 27 is then inserted inside sleeve 67 of guide member 66, and spacer 76 is placed on shoulder 74 of body 12. Using an Allen wrench inside prismatic seat 79, thread 69 of portion 68 is then screwed to thread 18 of body 12 until flange 73 contacts spacer 76, which is obviously so selected as to prevent portion 68 from contacting ring nut 36.

At this point, spacer 82 is placed over guide member 66, with annular portion 83 against flange 73; spring 80 is placed on flange 73, and bush 81 on member 66; sleeve 49 of armature 27 is inserted between stem 48 and bush 81, and, by compressing spring 80, C-shaped ring 50 is inserted inside the groove on stem 48; and electromagnet 26 is inserted inside jacket 54, and spring 53 inside hole 31 of core 28.

At this point, seal 56 is inserted inside the seat on jacket 54; jacket 54 is inserted inside portion 55 of hollow body 12 so that core 28 contacts feet 84 of spacer 82 and end wall 57 of jacket 54; cover 62 is fitted to jacket 54, and thread 63 is screwed to thread 64 of hollow body 12 until shoulder 61 engages shoulder 59 of jacket 54, so that wall 57 presses core 28 against spacer 82, which in turn presses against flange 73; seal 92 is inserted inside hole 86 in end wall 57; and appendix 88 of ring 89 is inserted inside hole 86 until ring 89 rests against the outer surface of wall 57.

Injector 11 is therefore assembled by simply inserting the component parts one after the other, and sequentially screwing three ring nut elements, with no need for deforming metal edges or forming a plastic cap.

Operation of injector 11 is known, and will therefore be described only briefly.

When electromagnet 26 is energized, armature 27 is raised until stem 48 is arrested against sleeve 67 of guide member 66; and the fuel pressure in control chamber 41 opens metering valve 24 so that rod 10 is raised to open the orifice of the injection nozzle.

When electromagnet 26 is de-energized, spring 53 lowers stem 48 together with armature 27, and pushes ball 46 to close valve 24; and the fuel pressure in control chamber 41 now increases rapidly to lower rod 10 and so close the orifice of the injection nozzle.

As compared with known injectors, the advantages of injector 11 according to the invention will be clear from the foregoing description. In particular, jacket 54 of electromagnet 26, being integral with end wall 57, requires no deformation of the edge; there is absolutely no risk of magnetic core 28 being damaged; and no seals are required between core 28 and jacket 54.

Clearly, changes may be made to the injector as described and illustrated herein without, however, departing from the scope of the accompanying Claims. For example, spacer 76 may be defined by a bush fitted outside disk 37 of armature 27; and groove 77 of flange 73 may be replaced by one or more through holes in flange 73.

What is claimed is:

1. An internal combustion engine fuel injector comprising a hollow body (12) fitted with a nozzle; a metering valve (24) for opening said nozzle; and an electromagnet (26) for activating an armature (27) controlling said metering valve (24); said armature (27) being guided by a guide member (66); said metering valve (24) and said guide member (66) being fitted inside a cavity (17) of said hollow body (12); and said electromagnet (26) being housed inside a jacket (54) fitted to said hollow body (12); wherein said jacket (54) and an end wall (57) against which said electromagnet (26) rests constitute one piece.

2. An injector as claimed in claim 1, wherein said end wall (57), carries a discharge fitting (32); said guide member (66), having a thread (69) engaging a corresponding thread (18) of said hollow body (12).

3. An injector as claimed in claim 2, wherein said hollow body (12) has said cavity (17) having said corresponding thread (18); said metering valve (24) comprising a valve body (33) housed in said cavity (17) and connected to said hollow body (12) independently of said guide member (66).

4. An injector as claimed in claim 3, wherein said metering valve (24) has a flange (34) engaged by a ring nut (36) also screwed in said corresponding thread (18).

5. An injector as claimed in claim 1, wherein said electromagnet (26) has an annular core (28), which is kept resting against said end wall (57) by said guide member (66).

6. An injector as claimed in claim 5, wherein the inner surface (58) of said jacket (54) is cylindrical with no shoulders; a spacer (82) being provided between said guide member (66) and said core (28).

7. An injector as claimed in claim 6, wherein said armature (27) comprises a disk (37) cooperating magnetically with said core (28); a stem (48) of said armature (27) being connected to said disk (37); wherein said guide member (66) comprises a sleeve (67) for guiding said stem (48); the outer surface of at least a portion (68) of said sleeve (67) having the thread (69) of said guide member (66).

8. An injector as claimed in claim 7, wherein said spacer defines an intermediate member (82) between said core (28) and a flange (73) of said guide member (66) which rests against a further shoulder (74) of said hollow body (12).

9. An injector as claimed in claim 8, wherein said intermediate member (82) is of modular size to permit adjustment of a gap between said armature (27) and said core (28).

10. An injector as claimed in claim 9, wherein said disk (37) has a predetermined number of openings (39); wherein said intermediate member (82) has an annular portion which rests against said flange (73), and a number of feet (84) integral with said annular portion (83) and which fit through said openings (39) to engage said core (28).

11. An injector as claimed in claim 10, wherein said feet (84) of said intermediate member (82) are of modular length to permit adjustment of said gap.

12. An injector as claimed in claim 8, wherein between said flange (73) and said further shoulder (74), there is provided a further spacer (76) of modular thickness to permit adjustment of the travel of said armature (27) towards said core (28).

13. An injector as claimed in claim 1, wherein said jacket (54) is connected to said hollow body (12) by means of a cover (62) having a thread (63) screwed to another thread (64) of said hollow body (12).

14. An injector as claimed in claim 1, wherein said electromagnet (26) comprises a coil (29) supplied by an electric cable (87) embedded in a plastic body (88, 89); wherein said plastic body (88, 89) is in the form of a ring (89) having an appendix (88) in which said cable (87) is embedded; said appendix (88) being inserted inside a hole (86) in said end wall (57).

15. An injector as claimed in claim 13, wherein said metering value comprises a valve body provided with a flange, and wherein said metering valve (24) and said electromagnet (26) are fitted to said hollow body (12) by inserting said valve body into said cavity and screwing a ring nut to a thread of said cavity, then screwing said guide member to said thread, and then screwing the thread of said cover to said other thread.

* * * * *

UNITED STATES PATENT AND TRADEMARK OFFICE

CERTIFICATE OF CORRECTION

PATENT NO. : 6,126,094
DATED : October 3, 2000
INVENTOR(S) : Mario Ricco

It is certified that error appears in the above-identified patent and that said Letters Patent is hereby corrected as shown below:

On title page 1 item 73, "Riocerca" should read - - Ricerca - -.

Signed and Sealed this

Eighth Day of May, 2001

*Attest:*

Nicholas P. Godici

NICHOLAS P. GODICI

*Attesting Officer*

*Acting Director of the United States Patent and Trademark Office*